US005438837A

United States Patent [19]

Caldwell et al.

[11] Patent Number: 5,438,837

[45] Date of Patent: Aug. 8, 1995

[54] APPARATUS FOR STORING AND DELIVERING LIQUID CRYOGEN AND APPARATUS AND PROCESS FOR FILLING SAME

[75] Inventors: Bruce D. Caldwell, Hitchcock; Paul D. Duncan, League City, both of Tex.

[73] Assignee: Oceaneering International, Inc., Houston, Tex.

[21] Appl. No.: 957,599

[22] Filed: Oct. 6, 1992

[51] Int. Cl.[6] ..... F17C 13/00; F25D 23/12

[52] U.S. Cl. ..... 62/50.1; 62/50.7; 62/259.3

[58] Field of Search ..... 62/45.1, 47.1, 49.1, 62/50.1, 50.6, 50.7, 51.1, 54.1, 259.3

[56] References Cited

U.S. PATENT DOCUMENTS

| | | | |
|---|---|---|---|
| 2,344,765 | 3/1944 | Dana et al. | 62/47.1 |
| 2,415,972 | 2/1947 | Stinson | 244/135 |
| 2,444,612 | 8/1948 | Sauser et al. | 244/135 |
| 2,446,612 | 8/1948 | Sauser et al. | 244/135 |
| 2,740,563 | 4/1956 | Jackson | 222/464 |
| 2,835,263 | 5/1958 | Klank | 137/45 |
| 2,855,759 | 10/1958 | Chaiser | 62/50.7 |
| 2,990,695 | 7/1961 | Leffingwell, Jr. | 62/223 |
| 3,064,448 | 11/1962 | Whittington | 62/259 |
| 3,117,426 | 1/1964 | Fischer et al. | 62/223 |
| 3,227,208 | 1/1966 | Potter, Jr. et al. | 165/96 |
| 3,343,536 | 9/1967 | Brisson et al. | 128/142.5 |
| 3,345,641 | 10/1967 | Jennings et al. | 2/2.1 |
| 3,635,216 | 1/1972 | Curtis | 128/142.5 |
| 3,648,289 | 3/1972 | Moreland | 2/2.1 |
| 3,730,178 | 5/1973 | Moreland | 128/142.5 |
| 3,807,396 | 4/1974 | Fischel | 128/142 |
| 3,831,594 | 8/1974 | Rein | 128/142 |
| 4,038,833 | 8/1977 | Foessl | 62/223 |
| 4,133,376 | 1/1979 | Eilenberg et al. | 165/105 |
| 4,172,454 | 10/1979 | Warncke et al. | 128/142.5 |
| 4,203,458 | 5/1980 | Barrett et al. | 137/38 |
| 4,286,439 | 9/1981 | Pasternack | 62/259.3 |
| 4,339,927 | 7/1982 | Sarcia | 62/6 |
| 4,425,764 | 1/1984 | Lam et al. | 62/6 |
| 4,459,822 | 7/1984 | Pasternack et al. | 62/259.2 |
| 4,459,823 | 7/1984 | Josephs et al. | 62/268 |
| 4,489,569 | 12/1984 | Sitte | 62/514 R |
| 4,580,411 | 4/1986 | Orfitelli | 62/371 |
| 4,727,255 | 2/1988 | Monier et al. | 250/352 |
| 4,744,222 | 5/1988 | Murai et al. | 62/49 |
| 4,778,497 | 10/1988 | Hanson et al. | 62/11 |
| 4,783,853 | 11/1988 | Zuber | 2/2 |
| 4,838,270 | 6/1989 | Donnerhack et al. | 128/371 |
| 4,838,912 | 6/1989 | Amlinger | 62/9 |
| 4,854,128 | 8/1989 | Zeamer | 62/50.1 |
| 4,951,660 | 8/1990 | Lubitzsch | 128/201.27 |
| 5,214,925 | 6/1993 | Hoy et al. | 62/50.6 |
| 5,243,821 | 9/1993 | Schuck et al. | 62/50.6 |

FOREIGN PATENT DOCUMENTS

| | | |
|---|---|---|
| 1154397 | 10/1957 | France . |
| 1366113 | 6/1964 | France . |
| 2060863 | 5/1981 | United Kingdom . |

OTHER PUBLICATIONS

H. E. Agen et al., A Liquid Air Device For Cooling The Wearer of a Totally Enclosed Liquid Rocket Propellant Handler's Suit, H. E. Agen et al., pp. 196–202.

Perry et al., Chemical Engineer's Handbook, Fifth Edition, Graw-Hill Book Company, 17 pages, (1973).

J. S. Meserole and O. S. Jones, "Pressurant Effects on Cyrogenic Liquid Acquisition Deivces", pp. 1–32, published Aug. 1991 in *Journal of Spacecraft and Rockets.*

(List continued on next page.)

*Primary Examiner*—Henry A. Bennett
*Assistant Examiner*—William C. Doerrler
*Attorney, Agent, or Firm*—Vaden, Eickenroht, Thompson & Feather

[57] ABSTRACT

Disclosed is an apparatus for storing and delivering a liquid cryogen. The apparatus is a dewar having a rotating liquid cryogen intake, a rotating gas supply vent, and a rotating capacitance gauge. Also disclosed is a system and a process employing the system for liquefying a gas to produce a liquid cryogen in the dewar wherein the gas is subcritically cooled and then condensed in the pressure vessel of the dewar.

13 Claims, 4 Drawing Sheets

OTHER PUBLICATIONS

NASA, "Advanced EMU Gaseous-Oxygen top Liquid-Oxygen Converter Feasibility Study and Preliminary Design" Test Report, pp. 1-32 and Appendices A-C, dated Jun. 10, 1991, issued in the Las Cruces, New Mexico, U.S.A.

NASA, "An Overview of Zero Gravity Fluid Quantity Gaging", by Kroll et al., published in Houston, Texas, distributed after Jan. 5, 1991, 4 pages.

Ball, "Fluid Quantity Gaging", Final Report, by Mord et al., dated Dec. 5, 1988, 11 pages, publication place unknown.

"Cryogenic Systems", Second Edition, by Randall F. Barron, Department of Mechanical Engineering, Louisiana Tech University, published by Oxford University in New York, 1985, 6 pages→p. XIII.

E. P. McQuaid, "Magnetic Fluid Density Separation Sytstem For Fine Powders", Final Report, published in Lowell, Massachusetts, date of contract Jul. 1, 1974, 16 pages through p. 9.

McDonnell Douglas Astronautics Company, "Study and Design of Cryogenic Propellant Acquisition on Systems", Final Report, vol. 1, by Burge, et al., 24 pages, published in Huntington Beach, Californmia, Dec., 1973 through p. 4.

M. G. Kaganer, *Thermal Insulation in Cryogenic Engineering*, pp. 30∝31, 101, 142-155, 168-170, published in 1969 in Jerusalem, Israel.

Convair (Astronautics) Division General Dynamics Corportaion, "Liquid Behavior in a Zero-G Field", by Dr. Ta Li, published in San Deigo, California, dated Sep. 1960, 28 pages.

M. Adelberg, et al., *Applied Cryogenic Engineering* (Vance and Duke, eds.), publication place and date unknown, pp. 344-374, 381-394.

G. R. Schmidt, "An Investigation of the Thermophysics and Fluid Mechanics Associated with Liquid Retention of Cryogenic Propellants", pp. 1-20, publication place and date unknown.

G. H. Caine and A. V. Pradhan, "Pumps or Fans for Destratification of Hydrogen Liquid and Gas", pp. 778-738, publication name, date, and place unknown.

FIG. 3
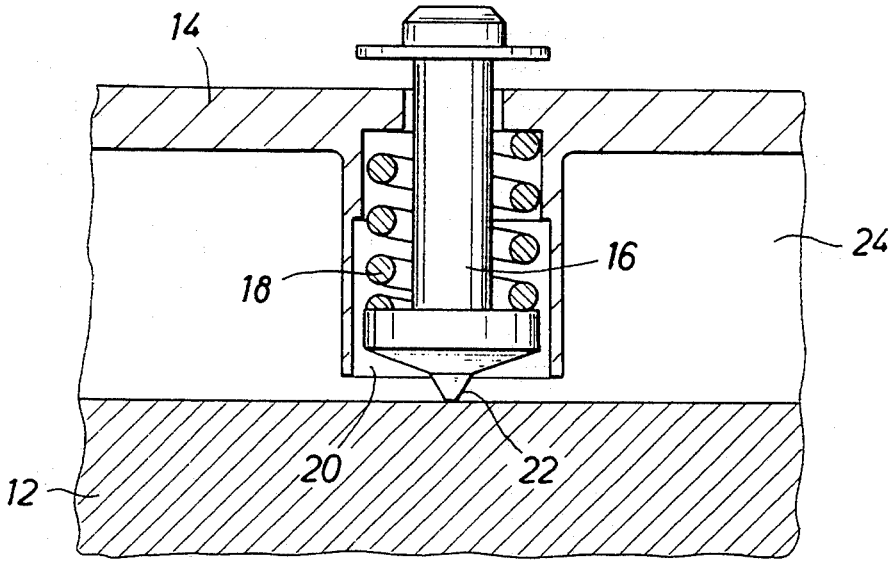
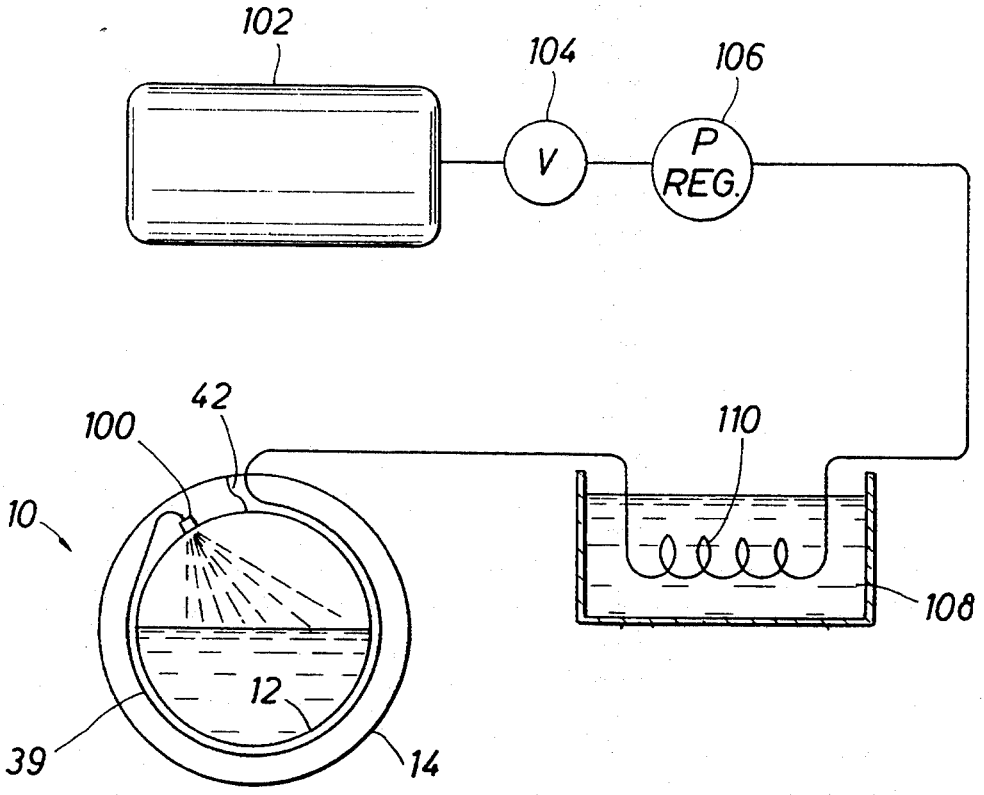
FIG. 6

APPARATUS FOR STORING AND DELIVERING LIQUID CRYOGEN AND APPARATUS AND PROCESS FOR FILLING SAME

BACKGROUND OF THE INVENTION

1. Field of the Invention

This invention pertains to the application of cryogenic technology to life support systems. More particularly, the invention pertains to a dewar for storing and delivering cryogenic and a rapid fill process for the dewar.

2. Description of the Prior Art

"Cryogenic" is a term used to describe physical conditions where the temperature is less than approximately 123K. A "cryogenic fluid" may be defined as a fluid whose temperature is less than approximately 123K and which boils (i.e., changes state from liquid to gas) at temperatures less than approximately 110K (−262° F., −163° C.) at atmospheric pressure. A cryogenic fluid may therefore be either a gas or a liquid.

Examples of cryogenic fluids include both nitrogen and oxygen (the primary components of "liquid air") as well as hydrogen, helium and methane. In accord with well known laws of nature, cryogenic fluids may boil at lower temperatures when they are under lower pressures or at higher temperatures under higher pressures. The term "cryogen" as used herein shall refer to a cryogenic fluid and the term "cryogenic technology" shall refer to knowledge, techniques, and equipment for harnessing physical properties of cryogenic fluids to practical applications.

Cryogenic technology has been employed in a wide variety of diverse fields. The field of portable life support systems has seen a resurgence of interest in cryogenic technology. Many portable life support systems utilizing cryogenic fluids store a liquid cryogen in a vacuum insulated pressure vessel from which liquid cryogen is delivered to other parts of the life support system. Typically, the pressure vessel is jacketed by an insulative housing, the space between the pressure vessel and the insulative housing being evacuated and sometimes filled with multi-layered insulation or reflective powders. This type of insulated pressure vessel is typically called a "dewar".

Any dewar (or insulated pressure vessel) used in a portable life support system will contain gas and, if filled, liquid cryogen. With the exception of portable life support systems used in micro-gravity or zero-gravity environments, most portable life support systems use dewars which rely on the force of gravity to separate liquid cryogen from gaseous cryogen. This separation is advantageous because gaseous cryogen can be pressurized to provide a motive force in delivering liquid cryogen from the dewar and because it enables control over whether liquid or gas is delivered from the dewar. Portable life support system designers therefore take advantage of the natural properties of the cryogen to deliver liquid cryogen from the dewar by pressurizing the separated gaseous cryogen.

Some of the current efforts at portable life support system design have focused on the use of liquid cryogen as part of a cooling loop for the system user to regulate the user's body temperature. The heat exchange process in the cooling loop warms the liquid cryogen, generally converting the liquid cryogen to gaseous cryogen. If the liquid cryogen is "liquid air", the gaseous cryogen can be warmed to provide an air supply for the breathing loop of the system. It is consequently necessary in this type of portable life support system to provide a constant, uninterrupted flow of liquid cryogen from the dewar and the ability to rapidly refill the dewar when the level of liquid cryogen is low. By implication, it is also necessary to be able to determine the amount of liquid cryogen in the dewar with high certainty.

The drawback to relying on gravity for separation therefore is that the liquid cryogen will shift positions within the dewar whenever the orientation of the dewar is changed with respect to gravity. The dewar for a portable life support system is usually worn on the back of the system user, so whenever the user bends at the waist (as opposed to standing up straight) the orientation of the dewar with respect to gravity changes. This change can occur in one, or both, planes of movement: (1) forward and back, and (2) side to side.

The shift in position of the dewar's liquid contents can expose the port through which liquid cryogen is delivered from the dewar during such movements regardless of which plane the movement takes place. When the port becomes exposed, the pressurized gaseous cryogen escapes through the port. This depressurizes the dewar, thereby eliminating the motive force and interrupting the delivery of liquid cryogen. For instance, if someone wearing a portable life support system stoops or bends over as if to lift something, the port may become exposed thereby allowing pressurized gas to escape through the port and interrupting delivery of liquid cryogen until the port is once again immersed in the liquid cryogen and pressure is restored to the dewar.

Another problem with liquid cryogen dewars is that current filling procedures require that stores of liquid cryogen be kept on hand. Liquid cryogens are purchased and stored until such time as they are needed. Where the liquid cryogen of choice is liquid air, both liquid oxygen and liquid nitrogen of breathable quality must be kept on hand, mixed when needed, and then decanted (or allowed to flow in response to a pressure gradient) into the dewar.

These filling and mixing procedures, however, are laborious and time consuming because of system requirements and the physical properties of liquid air. The liquid air mix of liquid oxygen and liquid nitrogen must be carefully produced and maintained and the improper balance in the amounts of liquid oxygen and liquid nitrogen is very undesirable. Liquid air therefore cannot generally be stored because the liquid nitrogen component will boil off, thereby leaving the liquid air merely an oxygen enriched oxygen nitrogen mix.

The inability to store liquid air for longer than about a day causes many problems for some portable life support uses such as fire fighting. Since fires cannot generally be predicted, the liquid air must be mixed under emergency conditions. Complex procedures necessary for handling liquid oxygen and the requisite care in mixing to obtain the proper percentages of liquid air components require time and lead to the loss of valuable response time.

An alternative to keeping liquid cryogen on hand would be to produce liquid cryogen on-site and then fill the dewar. Current processes for liquefying a gas to a liquid cryogenic fluid are predicated on the manipulation of the pressure and temperature of the substance from a gas at supercritical temperatures and pressures to a liquid at subcritical temperatures and pressures. Every substance has a characteristic "critical temperature" which is defined as the highest temperature at which a distinct liquid phase of the substance exists. Every substance also has a characteristic "critical pressure" which is the pressure at or above which there is no distinction between the liquid and gaseous phases of the substance.

The critical temperatures and pressures for most common cryogens are known and, for nitrogen, oxygen, and air (an oxygen/nitrogen mixture emulating earth's atmosphere), are listed in Table 1.

TABLE 1

| CRYOGEN | CRITICAL PRESSURES | CRITICAL TEMPERATURES |
|---|---|---|
| NITROGEN | 25 atm | 126K (−233° F., −147° C.) |
| OXYGEN | 50 atm | 155K (−182° F., −118° C.) |
| AIR | 38 atm | 133K (−220° F., −140° C.) |

Temperatures and pressures above the critical point values such as those listed in Table 1 are termed "supercritical" and temperatures and pressures below the critical point values are termed "subcritical". A cryogen may, depending on temperature and pressure, also be "supercritical" a term indicating that the cryogen is neither gas nor liquid but still exhibits physical properties of both.

Gas liquefaction processes generally begin with a gas at supercritical temperature and pressure, cool the gas to a subcritical temperature, and then pass the subcritically cooled substance through an expansion valve to produce a liquid at subcritical pressures and temperatures. However, known liquefaction processes are very time consuming because the objective is to produce as much liquid cryogen as possible with as little work as possible. A liquefaction process for a portable life support system must necessarily be different because (1) the chief objective is short fill time, and (2) the amount of work necessary to achieve liquefaction is not a governing factor. Thus, current fill processes are undesirable for portable life support systems.

Regardless of whether liquid air is produced on site or is mixed from stored liquid cryogens, it is desirable to refill the dewar as infrequently as possible to extend the activity time of the system user. This requires an accurate determination of liquid cryogen levels in the dewar at virtually all times. Current techniques employ a capacitance gauge in the dewar which distinguishes gas from liquid by their differing dielectrics. The capacitance of the gauge varies with the level of liquid, and so the shifting of liquid cryogen within the dewar caused by user movement also prohibits accurate determination of liquid cryogen levels in the dewar.

It is therefore an object of this invention to provide a dewar for the delivery of a liquid cryogenic fluid without interruption resulting from changes in orientation with regard to the field of gravity.

It is a further object of this invention to provide such a dewar for use in portable life support systems.

It is a still further object of this invention to provide such a dewar that can be filled more rapidly than conventional dewars without large liquid cryogen storage.

It is a still further object of this invention that it employs a new process for filling a dewar with liquid cryogen that is quicker than conventional techniques.

It is a still further object of this invention that it provides highly accurate indications of liquid cryogen levels in the dewar at virtually all times.

SUMMARY OF THE INVENTION

The invention is a new apparatus for storing and delivering liquid cryogen in a portable life support system. The apparatus is comprised of an insulated pressure vessel having a first means through which liquid cryogen may be supplied to and delivered from the pressure vessel and a second means through which a gas may be supplied to and vented from the pressure vessel. The first means includes an intake means having an open end, the internal portion of the intake means being mounted for rotating in the pressure vessel about a first axis. The interior wall of the pressure vessel is concentric to the first axis and the internal portion of the intake means is of such a length that the open end passes closely to the interior wall.

The apparatus is filled with a liquid cryogen by cooling a gas received at supercritical pressure and supercritical temperature to a subcritical temperature to obtain a supercritical cryogenic fluid. The pressure of the cryogenic fluid is then reduced within the apparatus to cool the fluid to subcritical levels and thereby condense the cryogen to a liquid state as it enters the vessel.

BRIEF DESCRIPTION OF THE DRAWINGS

A more particular description of the invention briefly summarized above can be had by reference to the preferred embodiments illustrated in the drawings in this specification so that the manner in which the above cited features, as well as others that will become apparent, are obtained and can be understood in detail. The drawings illustrate only preferred embodiments of the invention and are not to be considered limiting of its scope as the invention will admit to other equally effective embodiments. In the drawings:

FIG. 3 is an illustration of a part of the point contact suspension system used to suspend the insulated pressure vessel within the insulative housing of the preferred embodiment of the dewar;

FIG. 6 is a conceptualized diagram depicting the rapid fill process for the preferred embodiment of the dewar.

DESCRIPTION OF THE PREFERRED EMBODIMENTS

Figure 1:
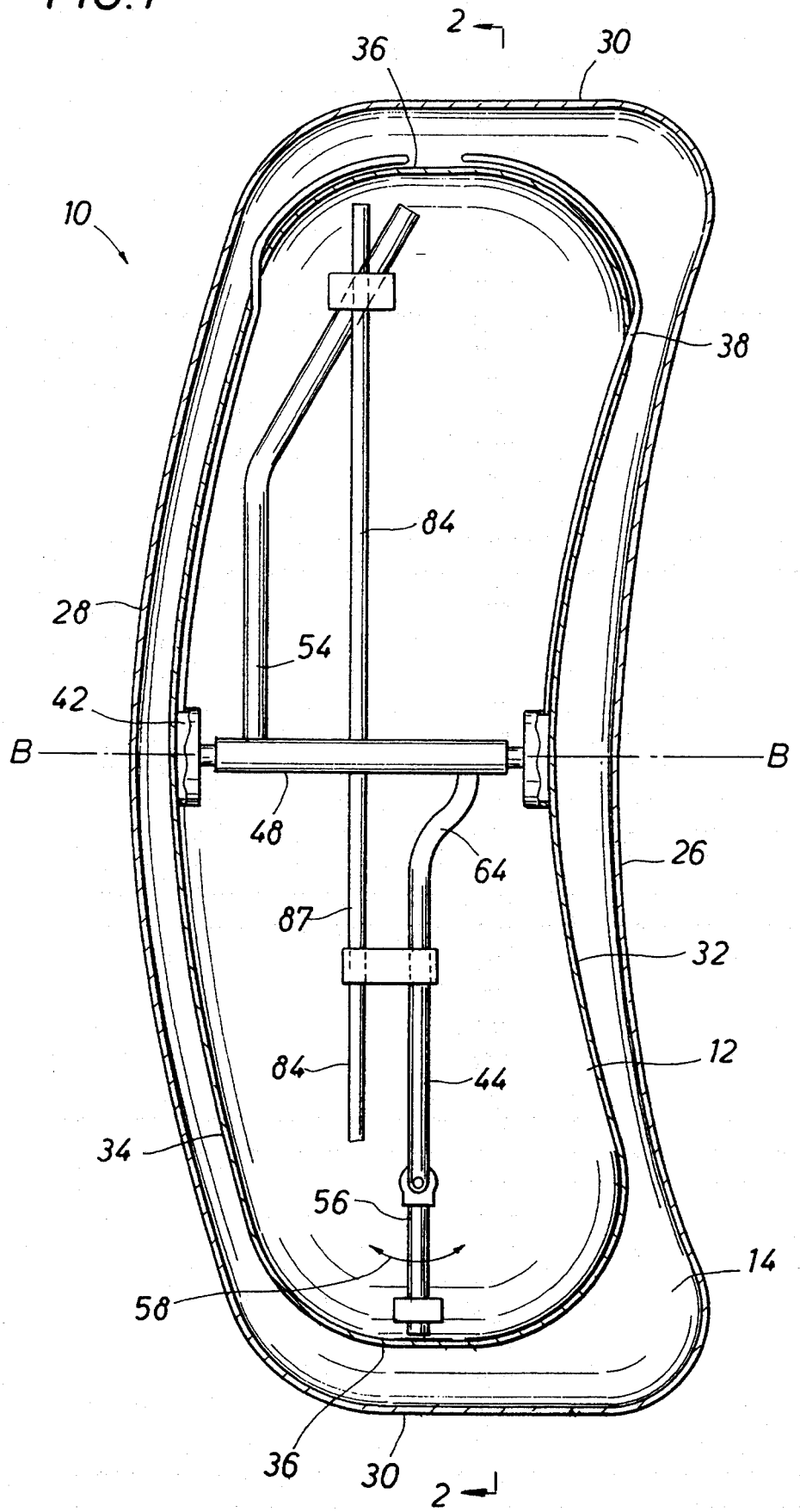
FIG. 1 is a cross sectional, side view of the dewar taken along line 1—1 of FIG. 2.

The dewar, generally denoted 10, is comprised of pressure vessel 12 mounted within insulative housing 14 as is best shown in FIG. 1. Dewar 10 in the preferred embodiment is intended for use as a "self-pressurizing dewar" i.e., gas produced by the system in the cooling loop is used to pressurize the contents of pressure vessel 12. Pressure vessel 12 is mounted within insulative housing 14 in a manner which minimizes transfer of heat from insulative housing 14 to pressure vessel 12. In the preferred embodiment, pressure vessel 12 is mounted using a point contact suspension system, a part of which is best shown in FIG. 3.

Each suspension point of the point contact suspension system is as illustrated in FIG. 3, and generally comprises reciprocable suspension member 16 biased inwardly by return spring 18 within recess 20. Contact end 22 of suspension member 16 is essentially a point to minimize surface contact and therefore heat transfer from insulative housing 14 to pressure vessel 12. The design of the suspension point allows for reciprocal movement of suspension member 16 to compensate for changes in dimension of pressure vessel 12 and insulative housing 14 caused by fluctuations and temperature and pressure.

The point contact suspension system of the preferred embodiment is not the only method by which pressure vessel 12 may be mounted within insulative housing 14. Many methods of suspension are known and used in the construction of dewars. Examples include straps and webbing, and any of these alternatives may be perfectly acceptable. Insulative housing 14 is not required in all embodiments of the invention, and the method of suspending pressure vessel 12 therein is not a consideration in such embodiments. For instance, the Earth's moon is a gravity rich environment but has no atmosphere such that pressure vessel 12 as further described herein would be vacuum insulated without insulative housing 14.

Figure 2:
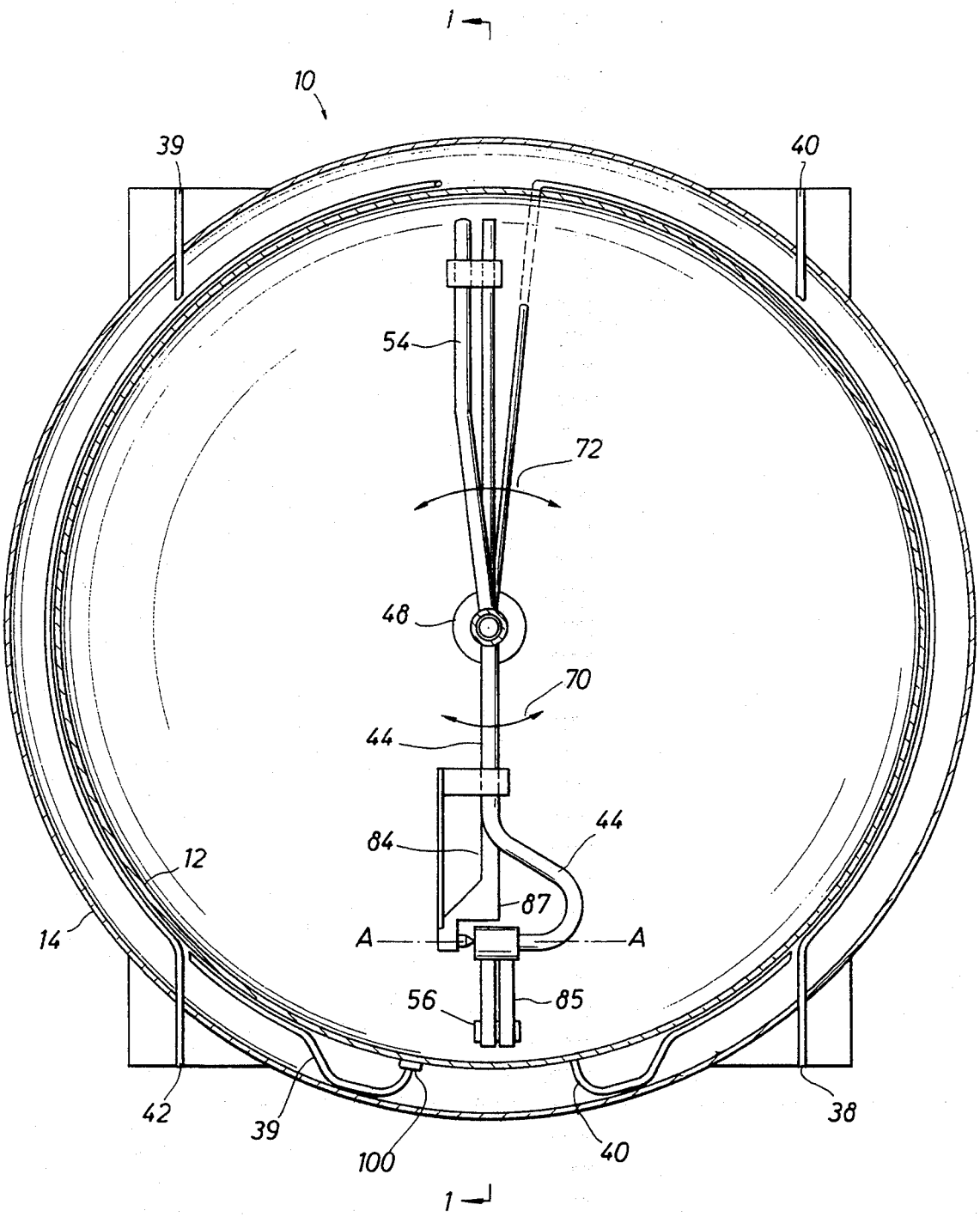
FIG. 2 is a cross sectional, elevational illustration of the dewar taken along line 2—2 of FIG. 1.

Still referring to FIG. 3, additional insulation for dewar 10 can be obtained by properly using annular space 24 between pressure vessel 12 and insulative housing 14. A vacuum is drawn in annular space 24 between pressure vessel 12 and insulative housing 14 as is shown in FIGS. 1 and 2. Additionally, annular space 24 may be filled with multi-layer insulation as is known in the industry (and shown in FIG. 3). Other methods such as filling annular space 24 with reflective powders may be equally acceptable. The inner and outer walls of pressure vessel 12 and/or insulative housing 14 may furthermore be gold- or silver-plated to reflect heat and thereby prevent heat transfer between pressure vessel 12 and insulative housing 14.

FIGS. 1 and 2 best illustrate the profiles of pressure vessel 12 and insulative housing 14 and, hence, dewar 10. Insulative housing 14 is comprised of first wall 26 and second wall 28, both of which are substantially circular in shape, and first side wall 30. Pressure vessel 12 is likewise comprised of first wall 32 and second wall 34, each of which are substantially circular in shape, and second side wall 36. First wall 26, second wall 28, third wall 32, and fourth wall 34 need not necessarily be circular in shape. However, the substantially circular shape of third wall 32 and fourth wall 34 of pressure vessel 12 greatly facilitate the delivery of liquid cryogen by a rotating intake as discussed below. Similarly, second side wall 36 need not necessarily be rounded as shown for the preferred embodiment but a rounded shape facilitates delivery of liquid cryogen.

Dewar 10 in the preferred embodiment is intended to be mounted on the back of portable life support user and first wall 26 and third wall 32 are therefore convex shaped to fit snugly against the back of the user and second wall 28 and fourth wall 34 are concave shaped, concave and convex being defined relative to the volumetric center of pressure vessel 12. To this extent, the use for which dewar 10 is intended also affects the profile of pressure vessel 12 and insulative housing 14 and any combination of convex and concave shape may be suitable or even desirable depending upon the particular application to which dewar 10 might be put. In operation, dewar 10 is filled with liquid cryogen via the liquid cryogen supply and delivery means and, more specifically in the preferred embodiment, fill lines 39 through 40 as described below.

Dewar 10 also has a means for supplying and delivering liquid cryogen to the pressure vessel and a means for supplying and venting a gas from the ullage of pressure vessel 12. The liquid cryogen supply and delivery means of dewar 10 is comprised of enclosed channel 38 and fill lines 39–40. The functions of fill lines 39–40 and enclosed channel 38 may be combined in some embodiments to produce a single fluid flow line for liquid cryogen although combining functions in this manner may encounter several practical problems with system design. However, the functions are separated in the preferred embodiment to avoid such problems and to permit more rapid fill of dewar 10 with liquid cryogen. Fill line 39 terminates in expansion valve 100 specifically for use in the rapid fill process discussed below in connection with FIG. 6. Fill line 40 does not include an expansion valve and can be used with conventional filling processes.

The gas supplying and venting means is generally comprised of enclosed channel 42. The supplying and venting functions of enclosed channel 42 may be performed by separate lines but the preferred embodiment does not do so because rapid fill is not limited by gas venting and combination of function reduces the number of structural elements. In some embodiments, enclosed channel 42, as well as enclosed channel 38, may inside be fluid flow lines such as fill lines 39–40, which are sealably joined to apertures in the wall of pressure vessel 12 so as to be fluidly connected to chamber 46 via perforations 49.

Figure 5:
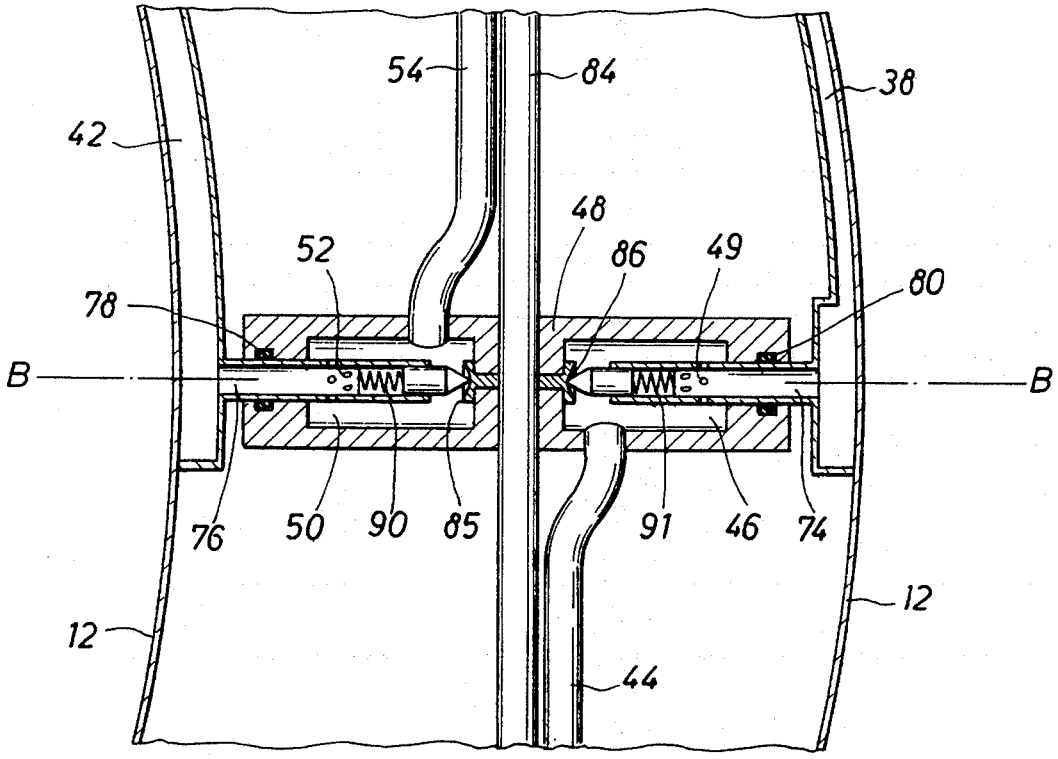
FIG. 5 is an enlargement of the second axis of rotation for the liquid cryogen intake, which is also the axis of rotation for the gas supply/vent member.

Dewar 10 also includes liquid cryogen intake member 44 and member 54, both of which rotate in the preferred embodiment. Intake member 44 is fluidly connected to the liquid cryogen supplying and delivering means as illustrated best in FIG. 5. Intake member 44 is a tubular member whose contents feed into chamber 46 of central hub 48. Liquid cryogen enters enclosed channel 38 from chamber 46 through a plurality of perforations 49 and is then delivered from dewar 10 via enclosed channel 38. The process of filling pressure vessel 12 with liquid cryogen will be discussed in connection with the rapid fill process illustrated in FIG. 6. Member 54 is tubular and is fluidly connected to enclosed channel 42 of the gas supply and delivery means as best shown in FIG. 5 such that gas may be supplied to and vented from the ullage of pressure vessel 12. Gas flows through tubular member 54 to chamber 50 of central hub 48, through perforations 52 to enclosed channel 42, and out enclosed channel 42 to vent gas. The process of supplying gas via member 54 is simply reversed from that of venting.

Figure 4:
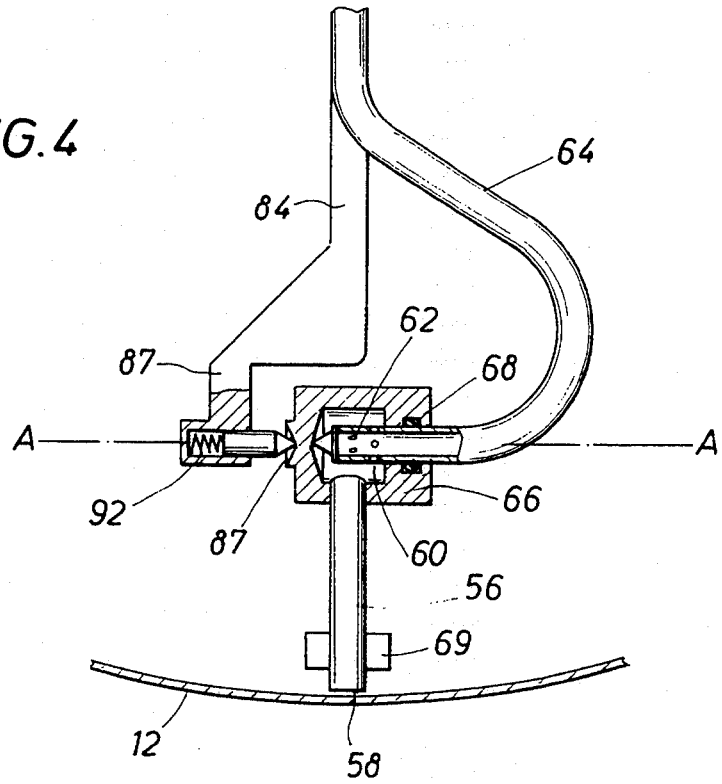
FIG. 4 is an enlargement of the immersed liquid cryogen intake and the first axis of rotation for the intake.

As noted above, both intake member 44 and member 54 rotate. Intake member 44 in the preferred embodiment has two axes of rotation, primary axis A—A shown in FIG. 2 and secondary axis B—B shown in FIG. 1. Intake member 44 may be conveniently described as consisting of main piece 64 and end piece 56 defined as the piece of intake member 44 between axis A—A and axis B—B and the piece between axis B—B and the end of intake member 44 most distal from central hub 48, respectively. Technically, end piece 56 of intake member 44 rotates about secondary axis B—B in a 180° arc illustrated by arrow 58 in FIG. 1. The juncture between end piece 56 and main piece 64 is best shown in FIG. 4. Liquid cryogen enters end piece 56, and hence intake member 44, via intake 58 in the end of end piece 56 and travels through chamber 60 and perforations 62 to enter main piece 64 of intake member 44. End piece 56 is fixedly attached to hub 66, hub 66 rotating about the end of main piece 64 in which perforations 62 are formed.

Chamber 60 is sealed at the point of rotation, the seal being held in place by snap ring 68 to maintain integrity of the fluid flow channel. The seal can be any one of several known to those in the art to be suitable for this purpose. Weight 69 is fixedly mounted to end piece 56 near intake 58 to ensure that end piece 56 rotates about axis A—A in response to gravity, although the weight and length of end piece 56 may be sufficient in some embodiments to eliminate the need for weight 69. Intake member 44 therefore sweeps side wall 36 of dewar 10 as end piece 56 rotates about primary axis of rotation A—A in the preferred embodiment.

Intake member 44 also rotates about secondary axis of rotation B—B illustrated in FIG. 1 as does member 54. Both intake member 44 and member 54 freely rotate about axis B—B through a full 360° as illustrated by arrows 70 and 72, respectively, in FIG. 2. Returning to FIG. 5, both intake member 44 and member 54 are fixedly attached to central hub 48. Central hub 48, and therefore intake member 44 and member 54, rotates about finger 74 of enclosed channel 38 and finger 76 of enclosed channel 42 in which perforations 49 and 52, respectively, are formed. Chambers 46 and 50 are sealed to the point of rotation by snap rings 78 and 80 respectively. Intake member 44 and member 54 in the preferred embodiment are sufficient in length to extend nearly all the way to side wall 37 and therefore circumscribe side wall 36 of pressure vessel 12 as they rotate about secondary axis B—B.

Dewar 10 in the preferred embodiment therefore incorporates two axes of rotation such that intake member 44 both sweeps and circumscribes side wall 36. However, it is not necessary to both sweep and circumscribe side wall 37 to practice the invention, either sweeping or circumscribing is sufficient although it is preferable to perform both functions. It is consequently not necessary that third wall 32 and fourth wall 34 be substantially circular or that side wall 36 be rounded. For instance, if the preferred embodiment in FIGS. 1–5 were modified so that intake member 44 did not rotate about axis B—B to circumscribe side wall 36, third wall 32 and fourth wall 34 could be shaped differently (even differently from each other) than as shown in the preferred embodiment without detracting from the ability of intake member 44 to sweep side wall 36. Conversely, if intake member 44 circumscribes but does not sweep side wall 36, side wall 36 need not be rounded since the roundness of side wall 36 facilitates sweeping only. The profile of the pressure vessel of dewar 10 (pressure vessel 12 in the preferred embodiment) is therefore primarily predicated on the selection and placement of the axis or axes of rotation in dewar 10.

Gas of some sort is also generally supplied to the ullage of pressure vessel 12 in order to pressurize the contents. Alternatively gas pressure buildup during filling may be vented to operational levels of approximately 4 atm. Either way, gravity will operate to separate the liquid cryogen from the gas cryogen because of their differing specific gravities, the heavier liquid cryogen being layered on the "bottom" of the dewar "beneath" the gas cryogen. Weight 69 on end piece 56 of intake member 44 causes intake member 44 to rotate in response to gravity although the length and weight of intake member 44 may ensure rotation without weight 69 in some embodiments. More specifically, weight 69 is mounted to the end of end piece 56 most distal from primary axis of rotation A—A and is sufficiently heavy to ensure the rotation of intake member 44 about both primary axis of rotation A—A and secondary axis of rotation B—B to ensure that intake 58 remains immersed in the liquid cryogen. Thus, intake member 44 rotates in response to gravity to ensure that intake 58 remains immersed in the liquid cryogen.

Because both intake member 44 and member 54 are fixedly attached to central hub 48, member 54 rotates as intake member 44 rotates in response to gravity. Furthermore, since member 54 and intake member 44 extend from central hub 48 in opposite directions, member 54 rotates in response to gravity to ensure that it remains at least partially emergent from the liquid cryogen. It is desirable for the gas supply/vent of member 54 to remain emergent to avoid bubbling gas through the liquid, which could adversely affect the oxygen/nitrogen ratios of the mix. However, in some embodiments this factor may not be a consideration and a conventional, non-rotating gas supply/vent may be used. Because intake 58 remains immersed in the liquid cryogen, there is no interruption of liquid cryogen delivery and the contents of dewar 10 are never depressurized as a result of a change in the orientation of dewar 10 with respect to gravity.

The preferred embodiment of dewar 10 also contains a gauge by which the liquid cryogen contents of the dewar may be measured. The relationship of gauge 84 to the other components of dewar 10 discussed thus far is best illustrated in FIG. 1. Gauge 84 is a capacitance gauge, whose capacitance is proportional to the depth of the liquid in which it operates and which distinguishes liquid cryogen from gas cryogen by their differing dielectrics. Capacitance gauges such as gauge 84 are well known in the art and comprises an outer shell and a concentric inner plate, which is typically tubular. The outer shell of end piece 85 must be wired to the outer shell of main piece 87 and the inner plate of end piece 85 must be wired to the inner plate of main piece 87 of guage 84.

The capacitance of gauge 84 is monitored via electrical contacts 85–86 shown in FIG. 5 and electrical contact 87 shown in FIG. 4, through electrical leads (not shown) routed through intake member 44 and enclosed channel 38, and enclosed channel 42. Alternatively, one of electrical contacts 85–86 can be grounded to pressure vessel 12 to eliminate one such lead. Furthermore, electrical contact 87 may be replaced with two simple leads, one each to the inner plate and outer shell of end piece 85. Springs 90–92 provide temperature compensation by maintaining the electrical contacts 85–87 as dimensions of the structural elements change in response to fluctuations in temperature and pressure. Furthermore, because gauge 84 is affixed to member 54 at point 94 on one end of gauge 84 and is affixed at point 96 to intake member 44 on the other end, gauge 84 rotates in response to gravity as do member 54 and intake member 44 about secondary axis of rotation B—B to ensure that the same end of gauge 84 remains immersed in the liquid cryogen. In some embodiments, end piece 85 of gauge 84 rotates about axis A—A with end piece 54 of intake member 44 to sweep as well as circumscribe side wall 26.

The rapid fill process employed with the preferred embodiment is conceptually illustrated in FIG. 6.

Dewar 10 in its preferred embodiment with expansion valve 100 expansion valve 100 is the terminal end of fill lines 39 shown in FIG. 2 and hence is a part of the liquid cryogen supply and delivery means. As known in the art, the Joule-Thomson effect produced by an expansion valve can be induced in any manner of appropriate flow restriction, perhaps even a simple orifice in some cases. However, the preferred embodiment employs an expansion valve, sometimes known as a Joule-Thomson valve, manufactured by Lee Co. Expansion valve 100 is fitted in an aperture in pressure vessel 12 using techniques well known in the industry such as welding or expansion fittings made by Lee Co.

Returning to FIG. 6, container 102 is a source of air (or some other gaseous cryogen) under pressure, typically 3,000–4,000 psi, at ambient temperature or higher. The compressed air may be obtained by compressing ambient atmosphere or purchased by the bottle already compressed. Either way, the compressed air must be scrubbed and filtered to remove carbon dioxide, water, Argon, and other contaminants to produce a gaseous mixture primarily composed of nitrogen and oxygen. The pressure and temperature of the cryogen in container 102 is not particularly important as long as the pressure is supercritical.

The compressed air is released from container 102 using valve 104, which may be automated or manual and may be any one of many known to the art. The pressure of the cryogen released from container 102 with valve 104 is then regulated by pressure regulator 106, if necessary, to approximately 1,000 psi. The value of 1,000 psi is chosen as a convenient value which is a supercritical pressure for oxygen and nitrogen and thus other levels may be acceptable depending on the particular cryogen being processed and the process being used. The pressure regulation of the cryogen also introduces some cooling but such cooling is incidental. The prime requirement is that the cryogen be at a supercritical pressure before the next step in the process.

The cryogen is then cooled to a subcritical temperature. The preferred embodiment illustrated in FIG. 6 employs liquid nitrogen bath 108 in which heat exchanger coil 110 is immersed. However, a helium closed-cycle refrigerator or a liquid nitrogen counterflow heat exchanger (as well as several other alternatives known to the art) may also be employed. Furthermore, liquid Argon may be substituted for the liquid nitrogen in bath 108 with corresponding adjustments to the temperature of bath 108. The temperature of the liquid nitrogen in bath 108 is maintained at approximately 77K (the boiling point of nitrogen at atmosphere pressure). In the preferred embodiment, the air is cooled to approximately 77K. The general rule for this step is that cooler is better, although care must be taken to avoid cooling the cryogen to the point of solidification.

Although the cryogen is cooled to a subcritical temperature, it is at supercritical pressure and hence is a supercritical fluid that is neither gas nor liquid but exhibiting properties of both. This is an important feature of the present invention because, as a supercritical fluid, the oxygen nitrogen ratios of the mix remain unchanged. If the cryogen is not supercritical, the oxygen and nitrogen may separate by condensing one without the other because of their differing physical characteristics. The oxygen nitrogen separation will then lead to alteration of the mix. It is therefore necessary to keep the fluid supercritical to maintain the mix.

The supercritical fluid enters the liquid cryogen supply and delivery means (i.e., fill line 39 in the preferred embodiment) of dewar 10 as a cryogen under a pressure gradient and then enters pressure vessel 12 of dewar 10 via expansion valve 100. The cryogenic fluid enters expansion valve 100 at supercritical pressure and subcritical temperature and completely condenses into a liquid phase because of the drop to a subcritical pressure caused by the Joule-Thomson effect. The condensed cryogen exits the expansion valve as a plurality of very cold droplets which scatter throughout pressure vessel 12. This scattering of very cold droplets cools pressure vessel 12 rapidly and hence promotes the rapid fill of dewar 10.

As is known in the art, a pressure drop of about 204 atm (approximately 3,000 psi) across expansion valve 100 will produce the most efficient liquefaction of the cryogen. However, higher source pressures makes the delivery much more difficult and so it is preferred that the pressure of the gas be at approximately 1,000 psi before it is cooled to a subcritical temperature. On the other hand, continuously drawing gas at 1,000 psi from a container storing gas at 1,000 psi will soon deplete the available pressure. This is well known in the art and the chosen compromise is represented by the preferred embodiment illustrated in FIG. 6. The practical implication, however, is that source 102 may contain air under only 1,000 psi or that air under pressure in the range of 3,000–4,000 psi may be cooled to subcritical temperatures, either option thereby eliminating the need for regulator 106.

Gas supplying and venting means 42 is equipped with a relief valve not shown to prevent the contents of dewar 10 from over-pressure conditions. The relief valve vents gas when the content pressure exceeds approximately 4 atm, which is also the operating pressure of dewar 10. In the event the contents of dewar 10 are under less than operating pressure, the contents may be pressurized via gas supplying and venting means 42 as described above.

It is therefore evident that the invention claimed herein may be embodied in alternative and equally satisfactory embodiments without departing from the spirit or essential characteristics thereof. Those of ordinary skill in the art having the benefits of the teachings herein will quickly realize beneficial variations and modifications on the preferred embodiments disclosed herein such as that discussed in the above paragraph, all of which are intended to be within the scope of the invention. The preferred embodiments must consequently be considered illustrative and not limiting of the scope of the invention.

What is claimed is:

1. An apparatus for storing and delivering a liquid cryogenic fluid, comprising:

an insulated pressure vessel;

first means through which liquid cryogen may be supplied to and delivered from the pressure vessel;

second means through which a gas may be supplied to the pressure vessel and vented from the pressure vessel;

said first means including:

intake means having a first section extending through an opening into the pressure vessel, and a second section having an open end, the second section hingedly connected to the first section for swinging about a second axis perpendicular to the first axis;

first means mounting the internal portion of said first means for rotating in the vessel about a first axis to which the first section of the intake means is mounted; and the inner wall of the pressure vessel concentric to the first axis being so formed and said internal portion being of such length that the open end of the intake means passes closely to the interior wall as the pressure vessel is caused to incline with respect to a plane passing through said first axis; and a capacitance gauge having:

a first section carried by said first section of said intake means for rotation therewith within the pressure vessel;

a second section carried by said second section of said intake means for rotation therewith within the vessel; and means electrically connected to said first section of said gauge and to said second section of said gauge to transmit a signal proportional to the capacitance thereof.

2. An apparatus for storing and delivering a liquid cryogenic fluid, comprising:

an insulated pressure vessel comprising first and second substantially circular walls joined by a side wall, the first wall being at least one of substantially concave and convex;

first means through which liquid cryogen may be supplied to and delivered from the pressure vessel;

second means through which a gas may be supplied to the pressure vessel and vented from the pressure vessel;

said first means including:

intake means having an open end and extending into the pressure vessel;

first means mounting the internal portion of said first means for rotating in the vessel about a first axis; and the inner wall of the pressure vessel concentric to the first axis being so formed and said internal portion being of such length that the open end of the intake means passes closely to the interior wall as the pressure vessel is caused to incline with respect to a plane passing through said first axis.

3. An apparatus for storing and delivering a liquid cryogenic fluid, comprising:

an insulated pressure vessel comprising first and second substantially circular walls joined by a side wall, the second wall being a least one of substantially concave and convex, first means through which liquid cryogen may be supplied to and delivered from the pressure vessel;

second means through which a gas may be supplied to the pressure vessel and vented from the pressure vessel;

said first means including:

intake means having an open end and extending into the pressure vessel;

first means mounting the internal portion of said first means for rotating in the vessel about a first axis: and the inner wall of the pressure vessel concentric to the first axis being so formed and said internal portion being of such length that the open end of the intake means passes closely to the interior wall as the pressure vessel is caused to incline with respect to a plane passing through said first axis.

4. An apparatus for storing and delivering a liquid cryogenic fluid, comprising:

an insulated pressure vessel;

first means through which liquid cryogen may be supplied to and delivered from the pressure vessel;

second means through which a gas may be supplied to the pressure vessel and vented from the pressure vessel;

said first means including:

intake means having an open end and extending into the pressure vessel;

first means mounting the internal portion of said first means for rotating in the vessel about a first axis;

the inner wall of the pressure vessel concentric to the first axis being so formed and said internal portion being of such length that the open end of the intake means passes closely to the interior wall as the pressure vessel is caused to incline with respect to a plane passing through said first axis; and an expansion valve.

5. A system for filling a dewar with liquid cryogen wherein the dewar includes:

an insulative housing;

a pressure vessel mounted within the housing;

means for venting gas from the pressure vessel to prevent overpressurization of the pressure vessel; and means of supplying cryogen to the pressure vessel; said system comprising:

a source of gas under supercritical pressure;

means for cooling the gas to a subcritical temperature at a supercritical pressure to obtain a supercritical cryogenic fluid; and means for reducing the pressure of the cryogen fluid within the dewar to cool the cryogenic fluid to subcritical levels and thereby condense the cryogenic fluid to a liquid state as it enters the pressure vessel.

6. The system of claim 5, wherein the cooling means comprises at least one of a heat exchange coil immersed in a liquid nitrogen bath and a closed cycle helium refrigerator.

7. The system of claim 5, wherein the reducing means is an expansion valve.

8. The system of claim 5, wherein the reducing means is an expansion valve mounted to the exterior of the pressure vessel within the housing.

9. A process for filling a liquid cryogen dewar comprised of a pressure vessel mounted within an insulative housing, the process comprising the steps of:

cooling a gas received at a supercritical pressure and a supercritical temperature to a subcritical temperature to produce a supercritical cryogenic fluid;

reducing the pressure of the cryogenic fluid within the dewar as the cryogenic fluid enters the pressure vessel to condense the cryogenic fluid to a liquid state; and selectively venting gas from the pressure vessel to prevent overpressurization of the pressure vessel.

10. The process of claim 9, wherein the gas is subcritically cooled by at least one of immersing a heat exchange coil carrying the cryogen in a liquid nitrogen bath, passing the gas through a closed cycle helium refrigerator, and passing the gas through a counter flow liquid nitrogen heat exchanger.

11. The process of claim 9, wherein the pressure of the cryogenic fluid is reduced by an expansion valve.

12. The system of claim 5, wherein the means for venting and means for supplying further comprise:

first means through which liquid cryogen may be supplied to and delivered from the pressure vessel;

second means through which a gas may be supplied to the pressure vessel and vented from the pressure vessel;

said first means including:

intake means having an open end and extending into the pressure vessel;

first means mounting the internal portion of said first means for rotating in the vessel about a first axis; and the inner wall of the pressure vessel concentric to the first axis being so formed and said internal portion being of such length that the open end of the intake means passes closely to the interior wall as the pressure vessel is caused to incline with respect to a plane passing through said first axis.

13. The process of claim 9, wherein the dewar further comprises:

first means through which liquid cryogen may be supplied to and delivered from the pressure vessel;

second means through which a gas may be supplied to the pressure vessel and vented from the pressure vessel;

said first means including:

intake means having an open end and extending into the pressure vessel;

first means mounting the internal portion of said first means for rotating in the vessel about a first axis; and the inner wall of the pressure vessel concentric to the first axis being so formed and said internal portion being of such length that the open end of the intake means passes closely to the interior wall as the pressure vessel is caused to incline with respect to a plane passing through said first axis.

* * * * *

US005438837B1

REEXAMINATION CERTIFICATE (2821st)

United States Patent [19] [11] B1 5,438,837

Caldwell et al. [45] Certificate Issued Jul. 27, 1999

[54] APPARATUS FOR STORING AND DELIVERING LIQUID CRYOGEN AND APPARATUS AND PROCESS FOR FILLING SAME

[75] Inventors: Bruce D. Caldwell, Hitchcock; Paul D. Duncan, League City, both of Tex.

[73] Assignee: Oceaneering International, Inc., Houston, Tex.

Reexamination Request:
No. 90/004,772, Sep. 30, 1997

Reexamination Certificate for:

| | |
|---|---|
| Patent No.: | **5,438,837** |
| Issued: | **Aug. 8, 1995** |
| Appl. No.: | **07/957,599** |
| Filed: | **Oct. 6, 1992** |

[51] Int. Cl.[6] ..... F17C 13/00; F25D 23/12

[52] U.S. Cl. ..... 62/50.1; 62/50.7; 62/259.3

[56] References Cited

FOREIGN PATENT DOCUMENTS 414170 5/1925 Germany .

*Primary Examiner*—William C. Doerrler

[57] ABSTRACT

Disclosed is an apparatus for storing and delivering a liquid cryogen. The apparatus is a dewar having a rotating liquid cryogen intake, a rotating gas supply vent, and a rotating capacitance gauge. Also disclosed is a system and a process employing the system for liquefying a gas to produce a liquid cryogen in the dewar wherein the gas is subcritically cooled and then condensed in the pressure vessel of the dewar.

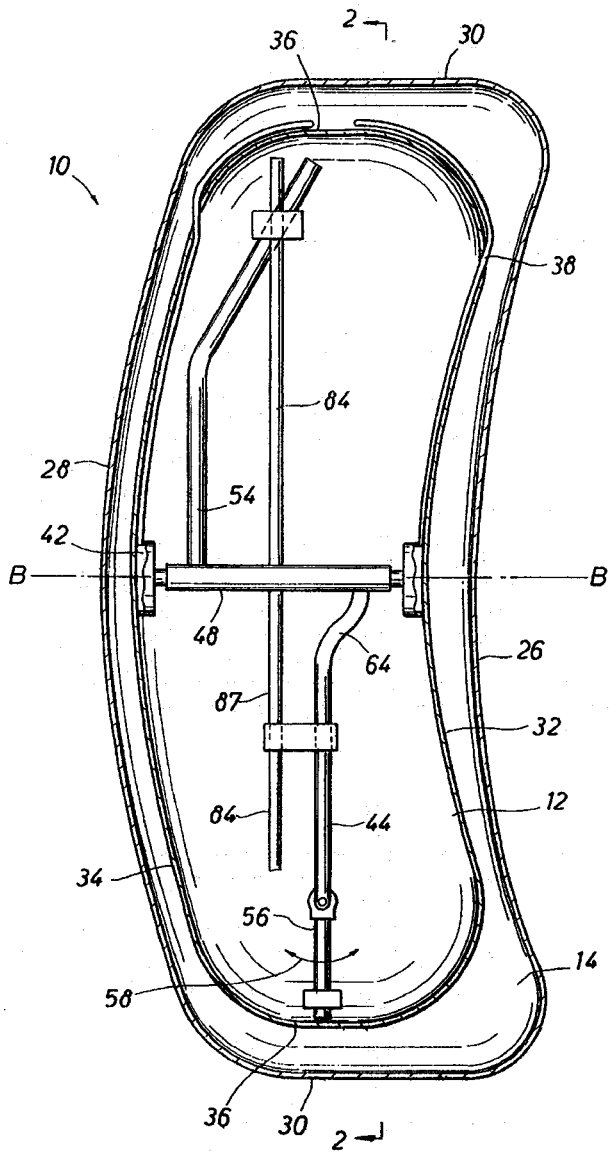

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 5–11 is confirmed.

Claims 1–4, 12 and 13 are determined to be patentable as amended.

New claims 14–21 are added and determined to be patentable.

1. An apparatus for storing and delivering a liquid cryogenic fluid, comprising:

an insulated pressure vessel;

first means through which liquid cryogen may be supplied to and delivered from the pressure vessel;

second means through which a gas may be supplied to the pressure vessel and vented from the pressure vessel;

said first means including:

intake means having a first section extending through an opening into the pressure vessel, and a second section having an open end, the second section hingedly connected to the first section for swinging about a second axis perpendicular to [the] *a* first axis;

[first] *mounting* means *for* mounting the internal portion of said first means for rotating in the vessel about [a] *said* first axis to which the first section of the intake means is mounted; and the inner wall of the pressure vessel concentric to the first axis being so formed and said internal portion being of such length that the open end of the intake means passes closely to the interior wall as the pressure vessel is caused to incline with respect to a plane passing through said first axis; and a capacitance gauge having:

a first section carried by said first section of said intake means for rotation therewith within the pressure vessel;

a second section carried by said second section of said intake means for rotation therewith within the vessel; and means electrically connected to said first section of said gauge and to said second section of said gauge to transmit a signal proportional to the capacitance thereof.

2. An apparatus for storing and delivering a liquid cryogenic fluid, comprising:

an insulated pressure vessel comprising first and second substantially circular walls joined by a side wall, the first wall being at least one of substantially concave and convex;

first means through which liquid cryogen may be supplied to and delivered from the pressure vessel;

second means through which a gas may be supplied to the pressure vessel and vented from the pressure vessel;

said first means including:

intake means having an open end and extending into the pressure vessel

[first] *mounting* means *for* mounting the internal portion of said first means for rotating in the vessel about a first axis; and the inner wall of the pressure vessel concentric to the first axis being so formed and said internal portion being of such length that the open end of the intake means passes closely to the interior wall as the pressure vessel is caused to incline with respect to a plane passing through said first axis.

3. An apparatus for storing and delivering a liquid cryogenic fluid, comprising:

an insulated pressure vessel comprising first and second substantially circular walls joined by a side wall, the second wall being at least one of substantially concave and convex;

first means through which liquid cryogen may be supplied to and delivered from the pressure vessel;

second means through which a gas may be supplied to the pressure vessel and vented from the pressure vessel;

said first means including:

intake means having an open end and extending into the pressure vessel

[first] *mounting* means *for* mounting the internal portion of said first means for rotating in the vessel about a first axis; and the inner wall of the pressure vessel concentric to the first axis being so formed and said internal portion being of such length that the open end of the intake means passes closely to the interior wall as the pressure vessel is caused to incline with respect to a plane passing through said first axis.

4. An apparatus for storing and delivering a liquid cryogenic fluid, comprising:

an insulated pressure vessel;

first means through which liquid cryogen may be supplied to and delivered from the pressure vessel;

second means through which gas may be supplied to the pressure vessel and vented from the pressure vessel;

said first means including:

intake means having and open end and extending into the pressure vessel;

first means mounting the internal position of said first means for rotating in the vessel about a first axis;

the inner surface of the pressure vessel concentric to the first axis being so formed and said internal portion being of such length that the open end of the intake means passes closely to the [interior] *inner surface of said* inner wall as the pressure vessel is cause to incline with respect to a plane passing through said first axis; and an expansion valve *through which the liquid cryogen may be supplied to the vessel as a supercritical fluid*.

12. The system of claim 5, wherein the means for venting and means for supplying further comprise:

first means through which liquid cryogen may be supplied to and delivered from the pressure vessel;

second means through which a gas may be supplied to the pressure vessel and vented from the pressure vessel;

said first means including;

intake means having an open end and extending into the pressure vessel;

[first] *mounting* means *for* mounting the internal portion of said first means for rotating in the vessel about a first axis; and the inner wall of the pressure vessel concentric to the first axis being so formed and said internal portion being of such length that the open end of the intake means passes closely to the interior wall as the pressure vessel is caused to incline with respect to a plane passing through said first axis.

13. The process of claim 9, wherein the dewar further comprises:

first means through which liquid cryogen may be supplied to and delivered from the pressure vessel;

second means through which a gas may be supplied to the pressure vessel and vented from the pressure vessel;

said first means including;

intake means having an open end and extending into the pressure vessel;

[first] *mounting* means *for* mounting the internal portion of said first means for rotating in the vessel about a first axis; and the inner wall of the pressure vessel concentric to the first axis being so formed and said internal portion being of such length that the open end of the intake means passes closely to the interior wall as the pressure vessel is caused to incline with respect to a plane passing through said first axis.

*14. An apparatus for storing and delivering a liquid cryogenic fluid, comprising:*

*an insulated pressure vessel comprising first and second substantially circular end walls joined by a side wall, the first end wall being at least one of substantially concave and convex;*

*first means through which liquid cryogen may be supplied to and delivered from the pressure vessel;*

*second means through which a gas may be supplied to the pressure vessel and vented from the pressure vessel;*

*said first means including:*

*intake means having an open end and extending into the pressure vessel;*

*mounting means for mounting the internal portion of said first means for rotating in the vessel about a first axis;*

*the inner surface of the side wall of the pressure vessel concentric to the first axis being so formed and said internal portion being of such length that the open end of the intake means passes closely to the inner surface of the side wall as the pressure vessel is caused to incline with respect to a plane passing through said first axis, and*

*means mounting the open end of said internal portion of the intake means for rotating in the vessel about a second axis which is perpendicular to the first axis so as to sweep the inner surface of the side wall from one end wall to the other as the pressure vessel is caused to incline with respect to a plane passing through said second axis.*

*15. The apparatus of claim 14, wherein*

*one of the end walls is substantially concave and the other end wall is substantially convex, and*

*said end walls are spaced along the first axis a distance substantially less than their diameters.*

*16. The apparatus of claim 14, wherein*

*the second end wall is also at least one of substantially concave and convex, and*

*the inner surfaces of the end walls are generally concentric to one another, with their centers spaced along said first axis, and*

*the internal portion includes a main piece rotatable about said first axis and an end piece in which the open end is formed mounted on the main piece for rotation about a second axis perpendicular to the first axis so as to sweep closely to the inner surface of the end wall.*

*17. An apparatus for storing and delivering a liquid cryogenic fluid, comprising:*

*an insulated pressure vessel comprising first and second substantially circular end walls joined by a side wall, the first end wall being at least one of substantially concave and convex;*

*first means through which liquid cryogen may be supplied to and delivered from the pressure vessel;*

*second means through which a gas may be supplied to the pressure vessel and vented from the pressure vessel;*

*each of said first and second means including:*

*intake means having an open end and extending into the pressure vessel; and*

*mounting means for mounting the internal portion of said first and second means for rotating in the vessel about a first axis;*

*the inner surface of the side wall of the pressure vessel concentric to the first axis being so formed and said internal portion being of such length that the open end of the intake means passes closely to the inner surface of the side wall as the pressure vessel is caused to incline with respect to a plane passing through said first axis.*

*18. An apparatus for storing and delivering a liquid cryogenic fluid, comprising:*

*an insulated pressure vessel comprising first and second substantially circular end walls joined by a side wall, the second end wall being at least one of substantially concave and convex;*

*first means through which liquid cryogen may be supplied to and delivered from the pressure vessel;*

*second means through which a gas may be supplied to the pressure vessel and vented from the pressure vessel;*

*said first means including:*

*intake means having an open end and extending into the pressure vessel;*

*mounting means for mounting the internal portion of said first means for rotating in the vessel about a first axis;*

*the inner wall of the pressure vessel concentric to the first axis being so formed and said internal portion being of such length that the open end of the intake means passes closely to the interior inner wall as the pressure vessel is caused to incline with respect to a plane passing through said first axis, and*

*means mounting the open end of said internal portion of the intake means for rotating in the vessel about a second axis which is perpendicular to the first axis so as to sweep the inner surface of the side wall from one end wall to the other as the pressure vessel is caused to incline with respect to a plane passing through said second axis.*

*19. The apparatus of claim 18, wherein*

*one of the end walls is substantially concave and the other end wall is substantially convex, and*

*said end walls are spaced along the first axis a distance substantially less than their diameters.*

*20. The apparatus of claim 18, wherein*

*the second end wall is also at least one of substantially concave and convex,*

*the inner surfaces of the end walls are generally concentric to one another, with their centers spaced along said first axis and*

*the internal portion includes a main piece rotatable about said first axis and an end piece in which the open end is formed mounted on the main piece for rotation about a second axis perpendicular to the first axis so as to sweep closely to the inner surface of the end wall.*

*21. An apparatus for storing and delivering a liquid cryogenic fluid, comprising:*

*an insulated pressure vessel comprising first and second substantially circular end walls joined by a side wall, the second end wall being at least one of substantially concave and convex;*

*first means through which liquid cryogen may be supplied to and delivered from the pressure vessel;*

*second means through which a gas may be supplied to the pressure vessel and vented from the pressure vessel;*

*each of said first and second means including:*

*intake means having an open end and extending into the pressure vessel; and*

*mounting means for mounting the internal portion of said first and second means for rotating in the vessel about a first axis;*

*the inner wall of the pressure vessel concentric to the first axis being so formed and said internal portions being of such length that the open end of the intake means passes closely to the inner surface of the side wall as the pressure vessel is caused to incline with respect to a plane passing through said first axis.*

* * * * *